US006288677B1

(12) United States Patent
Fink

(10) Patent No.: US 6,288,677 B1
(45) Date of Patent: Sep. 11, 2001

(54) MICROSTRIP PATCH ANTENNA AND METHOD

(75) Inventor: Patrick W. Fink, Fresno, TX (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 0 days.

(21) Appl. No.: 09/451,814

(22) Filed: Nov. 23, 1999

(51) Int. Cl.[7] ..... H01Q 1/38

(52) U.S. Cl. ..... 343/700 MS; 343/845; 343/853

(58) Field of Search ..... 343/700 MS, 845, 343/850, 852, 853, 795; H01Q 1/38

(56) References Cited

U.S. PATENT DOCUMENTS

| | | | | |
|---|---|---|---|---|
| 4,191,959 | | 3/1980 | Kerr | 343/700 MS |
| 4,543,579 | | 9/1985 | Teshirogi | 343/365 |
| 4,713,670 | | 12/1987 | Makimoto et al. | 343/700 MS |
| 4,737,793 | * | 4/1988 | Munson et al. | 342/361 |
| 4,761,654 | | 8/1988 | Zaghloul | 343/700 MS |
| 4,833,482 | | 5/1989 | Trinh et al. | 343/700 MS |
| 4,866,451 | | 9/1989 | Chen | 343/700 MS |
| 4,943,809 | | 7/1990 | Zaghloal | 343/700 MS |
| 4,973,972 | | 11/1990 | Huang | 343/700 MS |
| 5,061,943 | * | 10/1991 | Rammos | 343/770 |
| 5,231,406 | | 7/1993 | Sreenivas | 343/700 MS |
| 5,510,803 | * | 4/1996 | Ishizaka et al. | 343/700 MS |
| 5,661,494 | | 8/1997 | Bondyopadhyay | 343/700 MS |
| 6,121,929 | * | 9/2000 | Olson et al. | 343/700 MS |

FOREIGN PATENT DOCUMENTS

| | | | | |
|---|---|---|---|---|
| 0 434 268-A2 | * | 6/1991 | (GB) | H01Q/9/04 |

* cited by examiner

*Primary Examiner*—Tho Phan
*Assistant Examiner*—Shih-Chao Chen
(74) *Attorney, Agent, or Firm*—Hardie R. Barr

(57) ABSTRACT

Method and apparatus are provided for a microstrip feeder structure for supplying properly phased signals to each radiator element in a microstrip antenna array that may be utilized for radiating circularly polarized electromagnetic waves. In one disclosed embodiment, the microstrip feeder structure includes a plurality of microstrip sections many or all of which preferably have an electrical length substantially equal to one-quarter wavelength at the antenna operating frequency. The feeder structure provides a low loss feed structure that may be duplicated multiple times through a set of rotations and translations to provide a radiating array of the desired size.

29 Claims, 3 Drawing Sheets

MICROSTRIP PATCH ANTENNA AND METHOD

ORIGIN OF THE INVENTION

The invention described herein was made by an employee of the United States Government and may be manufactured and used by or for the Government of the United States of America for governmental purposes without the payment of any royalties thereon or therefor.

BACKGROUND OF THE INVENTION

1. Field of the Invention

The present invention relates to apparatus and methods for circularly polarized antennas and, more specifically, to an improved feed structure for supplying appropriately phased signals to each element of an array of microstrip radiating patches configured in a low loss unit cell configuration.

2. Description of Prior Art

Circularly polarized antennas have been found to be especially useful for space communications involving satellite transmissions. While linearly polarized antenna systems are very useful for many purposes, the constraints of a linearly polarized antenna system for space communications may require that an Earth station maintain a tight alignment with a satellite to achieve acceptable communications. Maintaining the tight alignment through the Earth's atmosphere is difficult especially when the receivers are located on ships, aircraft, and other objects that change position and orientation. Circularly polarized radiation is less affected by alignment considerations.

As another significant advantage for satellite communications, microstrip patch antennas are generally relatively light and small. Due to the high launch cost for each pound of weight and because of the limited cargo space for space launched packages, the small size and weight attributes of a microstrip patch antenna make this type of antenna especially suitable for satellite applications.

Typically, the circularly polarized microstrip antennas are used in arrays where numerous radiating elements are used. However, with an array of multiple microstrip patches comes an attendant need for a complex feed structure to supply each microstrip patch with a suitable phase excitation. Each microstrip patch requires a dual feed excitation that is preferably of equal amplitude and in phase quadrature. Moreover, each different patch will typically need to be fed with a different relative phase excitation as compared to adjacent patches. As well, it is desirable to have as little power loss as possible through the feed structure so that most radiation will occur from the antenna rather than from the feed structure itself. The layout of the feed structure should preferably be simple and avoid sharp corners. The following patents disclose various feed structures that show attempts to solve this difficult problem over the last two decades.

U.S. Pat. No. 5,661,494, issued Aug. 26, 1997, to P. K. Bondyopadhyay, is hereby incorporated herein by reference and discloses a microstrip antenna for radiating circularly polarized electromagnetic waves comprising a cluster array of at least four microstrip radiator elements. The dual fed circularly polarized reference element is positioned with its axis at a 45° angle with respect to a unit cell axis. The other three dual fed elements in the unit cell are positioned and fed with a coplanar feed structure that results in sequential rotation and phasing. The centers of the radiator elements are disposed at the comers of a square with each side of a length d in the range of 0.7 to 0.9 times the free space wavelength of the antenna radiation. The radiator elements reside in a square unit cell area of sides equal to 2d and thereby permit the array to be used as a phased array antenna for electronic scanning and is realizable in a high temperature superconducting thin film material for high efficiency.

The present invention is especially suited for use with the exemplary unit cell configuration described in the above patent with respect to the disclosed microstrip patch positions and orientations. However, according to the present invention as discussed hereinafter, the feed lines to each patch are improved. Moreover, transmission line feed loss and circuit complexity is reduced according to the feed structure of the present invention.

U.S. Pat. No. 4,543,579, issued Sep. 24, 1985, to T. Teshirogi, discloses a circular polarization antenna having wide-band circular polarization characteristics and impedance characteristics is accomplished by feeding N-antenna elements which are shifted at an interval of $\pi/N$ radians with respect to the boresight direction with a differential phase shift of an interval of $\pi/N$ radians corresponding to the angular orientation of the antenna elements so as to obtain circular polarization with respect to the boresight direction.

U.S. Pat. No. 5,231,406, issued Jul. 27, 1993, to A. I. Sreenvas, discloses a circular polarization antenna wherein signals are fed to an array of electromagnetically coupled patch pairs arranged in sequential rotation by and interconnect network which is coplanar with the coupling patches of the patch pairs. The interconnect network includes phase transmission line means, the lengths of which are preselected to provide the desired phase shifting among the coupling patches.

U.S. Pat. No. 4,191,959, issued Mar. 4, 1980, to J. L. Kerr, discloses a microstrip antenna having an etched metal radiator element including a polarizing patch consisting of a two-dimensional removal of metallization from the central portion of the radiator element with one dimension of the polarization patch being greater than the other dimension, e.g., an elongated rectangle and selectively oriented with respect to the input axis whereby, for example, circular polarization is achieved by means of orienting the polarization patch substantially 45° with respect to the input axis.

U.S. Pat. No. 4,713,670, issued Dec. 15, 1987, to Makimoto et al., discloses a microwave plane antenna comprising a plurality of pairs of antenna elements connected at their one end to a power supply circuit and respectively including at the other terminating end an impedance-matched patch antenna means, whereby signal energy remaining at the terminating ends of the antenna elements is caused to be effectively utilized as radiation energy, and any power loss is restrained for a high antenna gain and improved aperture efficiency.

U.S. Pat. No. 4,943,809 and U.S. Pat. No. 4,761,654, issued Jul. 24, 1990 and Aug. 2, 1988, to A. L. Zaghloul, disclose a microstrip antenna array having broadband linear polarization, and circular polarization with high polarization purity, feed lines of the array being capacitively coupled to feed patches at a single feedpoint or at multiple feedpoints, the feeding patches in turn being electromagnetically coupled to corresponding radiating patches. The contactless coupling enables simple, inexpensive multilayer manufacture.

U.S. Pat. No. 4,973,972, issued Nov. 27, 1990, to J. Huang, discloses a circularly polarized microstrip array antenna utilizing a honeycomb substrate made of dielectric material to support on one side the microstrip patch elements in an array, and on the other side a stripline circuit for feeding the patch elements in subarray groups of four with angular orientation and phase for producing circularly polarized radiation, preferably at a 0°, 90°, 180°, and 270° relationship. The probe used for coupling each feed point in the stripline circuit to a microstrip patch element is teardrop shaped in order to introduce capacitance between the coupling probe and the metal sheet of the stripline circuit that serves as an antenna ground plane. The capacitance thus introduced tunes out inductance of the probe.

U.S. Pat. No. 4,833,482, issued May 23, 1989, to Trinh et al., discloses an antenna arrangement for radiating and receiving circularly polarized radiation. A first antenna array having parallel stripline conductors is disposed on the top surface of a dielectric substrate. The stripline conductors have radiating tabs protruding outwardly therefrom in a direction of about forty-five degrees from the stripline conductors. A second antenna array having a second plurality of stripline conductors are interdigitated with the first stripline conductors.

Those skilled in the art have long sought and will appreciate the present invention that addresses these and other problems.

SUMMARY OF THE INVENTION

A method is provided for a microstrip feed structure used with the microstrip array antenna unit cell configuration described in U.S. Pat. No. 5,661,494. The microstrip array antenna may be operable for radiating circularly polarized electromagnetic waves from a plurality of radiating elements. The radiating elements may be in coplanar relation. Each of the radiating elements has a radiation resistance at resonance. In the method of the present invention, the method comprises providing first and second microstrip feed lines to two orthogonal sides of the radiating element. The first and second feed lines that end at the microstrip patch each have an electrical length equal to one-quarter wavelength, on the microstrip line structure, at the operating frequency. As well, the first and second feed lines have identical characteristic impedances equal to a first characteristic impedance. A third microstrip section is provided in series with the first microstrip feed line. The third microstrip section is selected to provide a one-quarter wavelength phase shift. Moreover, the third microstrip section is provided with a third characteristic impedance that is equal to the impedance looking into the first feed line toward the radiating element.

Preferably, the end of the third microstrip section is connected with the end of the second microstrip section to form a first joint.

Preferably, a fourth microstrip section is connected to the first joint. A fifth microstrip section is connected in series to the fourth microstrip section. The fourth and fifth microstrip sections transform the usually low characteristic impedance at the first junction, looking toward the radiating element, to a higher characteristic impedance suitable for low loss transmission. Preferably, the fourth and fifth microstrip sections are each one-quarter wavelength in length with characteristic impedances selected to establish the higher impedance. The radiating element and the microstrip sections up to and including the fifth microstrip section may be referred to as Tier 1- Circuit A. A two element array may be formed by copying Tier 1- Circuit A, rotating it about an axis normal to the page, and translating it by the desired separation of the radiating elements. The direction of rotation may be either clockwise or counterclockwise depending on the desired polarization, left- or right-handed. The newly created section may be referred to as Tier 1- Circuit B.

A sixth microstrip section is connected in series to the fifth microstrip section of each Tier 1Circuit. Preferably, the sixth microstrip section has a characteristic impedance equal to the impedance seen looking into the fifth microstrip section toward the radiating element. The length, measured in electrical degrees at the operating frequency, of the sixth microstrip section for Tier 1- Circuit A, will differ from the length of the sixth microstrip section for Tier 1- Circuit B by an amount that corresponds to the physical angle by which Tier1- Circuit A is rotated to produce Tier1- Circuit B. The length of the sixth microstrip section is chosen to provide the desired distance between Tier 1- Circuit A and Tier 1- Circuit B.

A seventh microstrip section is added to the end of the sixth microstrip section on both Tier 1-Circuit A and Tier 1-Circuit B. The length and characteristic impedance of the seventh microstrip section establish an impedance at a second joint, which adjoins or connects the Tier 1-Circuit A and the Tier 1-Circuit B. The collection of Tier 1-Circuit A and Tier 1-Circuit B may be referred to as Tier 2-Circuit A. The impedance established by the seventh microstrip section at the second joint is sufficiently high such that a microstrip line, with a characteristic impedance of same value, is suitable for low loss transmission, from the second joint, to another microstrip circuit, without the need for an additional impedance transformation.

If a two-element array is desired, a final microstrip section eight may be added to the second joint with the purpose of matching the impedance at the joint to a characteristic impedance of a feed source or receiver line. In this case, it is preferable that the eighth microstrip section is one-quarter wavelength in length.

If a four element or larger array is desired, the two element circuit collection referred to as Tier 2-Circuit A may be copied, rotated, and translated to create an additional collection that may be referred to as Tier 2-Circuit B. An eighth microstrip section may be added to the second joint of each of Tier 2-Circuit A and Tier 2-Circuit B. The eighth microstrip sections from these two circuits connect at a third joint to form a collection of four radiating elements and collective microstrip feed network that may be referred to as Tier 3 Circuit A. The length of the eighth microstrip section connected to Tier 2-Circuit A differs from the length of the eighth microstrip section connected to Tier 2-Circuit B by an amount, measured in degrees, equal to the physical angle by which Tier 2-Circuit A is rotated to create Tier 2-Circuit B. Preferably, the characteristic impedance of the eighth microstrip section is equal to the impedance established by Tier 1-Circuit A and Tier 1-Circuit B at the second junction. In this preferred embodiment, the need for the additional transformer indicated in U.S. Pat. No. 5,661,494 is eliminated. In a similar manner, additional array sections may be created to cover the area required for the desired antenna gain.

In the basic 4-element unit cell, each of the unit cell sides (e.g., center of patch 56 to center of patch 58) may be substantially square and may have a side with a length in the range of 0.7 to 0.9 times the wavelength of the antenna operating frequency.

It is an object of the present invention to provide an improved method and feed line structure.

It is another object of the present invention to provide an improved method and apparatus for a feed line structure for the circularly polarized antenna formed by the unit cell configuration defined in U.S. Pat. No. 5,661,494.

An advantage of the present invention is to provide a simplified feed structure and method in a block form that may be used repeatedly for a larger number of radiating elements.

Another advantage, over the feed structure defined in U.S. Pat. No. 5,661,494 is that the present invention provides a 90-degree phase shift between the two orthogonal resonant modes.

Still another advantage over the feed structure defined in U.S. Pat. No. 5,661,494 is that the present invention eliminates two impedance transformers that, in U.S. Pat. No. 5,661,494 reside between the two 2-element pairs of the four element block. The elimination of these transformers eliminates the associated line and radiation losses and also simplifies the layout in a region that is typically characterized by a high density of feed structure.

Any listed objects, features, and advantages are not intended to limit the invention or claims in any conceivable manner but are intended merely to be informative of some of the objects, features, and advantages of the present invention. In fact, these and yet other objects, features, and advantages of the present invention will become apparent to those skilled in the art from the drawings, the descriptions given herein, and the appended claims.

Figure 1:
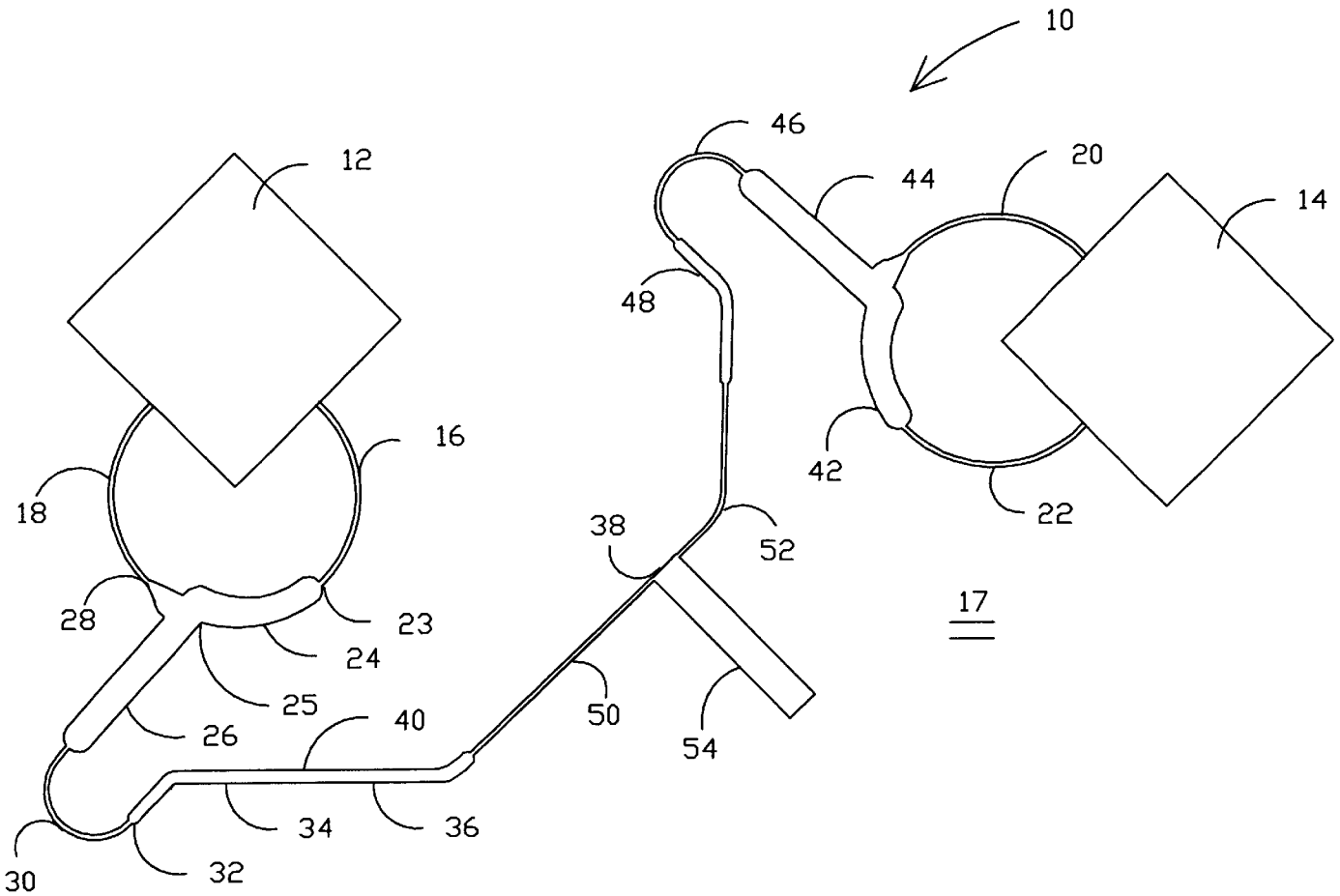
FIG. 1 is a schematic of a circuit layout for a feed structure in accord with the present invention.

While the present invention will be described in connection with presently preferred embodiments, it will be understood that it is not intended to limit the invention to those embodiments. On the contrary, it is intended to cover all alternatives, modifications, and equivalents included within the spirit of the invention and as defined in the appended claims.

BRIEF DESCRIPTION OF PREFERRED EMBODIMENTS

The present invention discloses an improved feed network for a circularly polarized antenna. It is especially useful with the radiator array configuration described in U.S. Pat. No. No 5,661,494, which is hereby incorporated by reference. In the present invention, an antenna array building block 10 is provided with a plurality of radiating patches such as patch 12 and patch 14. Patch elements 12 and 14 are conductive surfaces etched, mounted, or otherwise positioned on an insulative board or substrate surface 17. See also FIG. 3. An antenna array with many elements may be developed from a building block such as building block 10 that includes two patch elements, i.e., patch 12 and patch 14. Building block 10 may operate alone as a circularly polarized antenna but may also be duplicated multiple times through a set of rotations and translations to provide a larger antenna array of the desired size wherein larger arrays generally provide for greater antenna gain to enhance signal reception or transmission.

It is noted here that whereas the present invention is discussed mainly in terms of transmitting or radiating antennas and methods of construction and operation, that the same general design and construction also apply to receiving antennas and methods.

Figure 3:
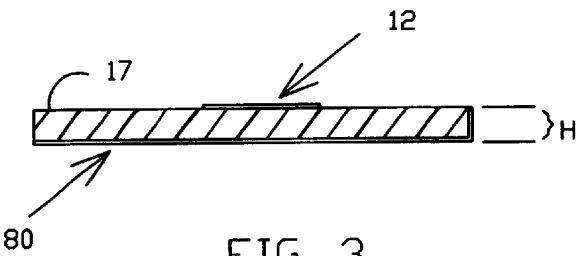
FIG. 3 is an elevational view, in section, of an antenna in accord with the present invention.

One aspect of the simplicity of the present design is that many of the elements in the feed structure are preferably quarter-wavelength elements in terms of the electrical wavelength of the signal on the microstrip. It will be understood that a quarter-wavelength for the signal on the transmission line elements such as the microstrip feed line is normally different than would be the equivalent quarter-wavelength of the signal in free space. As well, the characteristic impedance of the microstrip feed line will vary according to the various construction factors. As with the antenna elements, the microstrip feed lines are conductive surfaces in the shape of elongate lines that are etched, mounted, or otherwise positioned on an insulative board or substrate surface 17 as shown in FIG. 3. Thus, in the preferred embodiment of the present invention, the feed network is preferably coplanar with the antenna patch elements 12 and 14.

In the present design the radiation resistance $R_{rad}$ of each patch 12 and 14 will vary depending on their physical size wherein the sides are in the range of approximately 0.5 times the free space wavelength of the antenna radiation. A typical radiation resistance is about 270 Ohms.

Generally, the characteristic impedance of feed lines 16 and 18 is preferably selected based on the $R_{rad}$ and the range of realizable impedances as constrained by the relative dielectric constant and thickness of the dielectric supporting the transmission lines, as well as limitations in fabricating the width of the transmission lines. It is well known that, for materials commonly used for printed coplanar antennas, it is not feasible to assign the feed lines characteristic impedances equal to the radiation resistance of the radiating element. The characteristic impedance of feed lines 16 and 18 is equal. As discussed above, each of feed lines 16 and 18 are one-quarter wavelength long. It will be understood that the same characteristic impedance and length is used for feed lines 20 and 22. The characteristic impedance of each of lines 16, 18, 20, and 22 is referred to hereinafter for convenience while looking at FIG. 1 as $Z_{16}$.

The impedance $Z_{23}$ looking into line 16 toward patch 12 as indicated at point 23 is given by the following equation:

$$Z_{23} = \frac{Z_{16}^2}{R_{\text{rad}}},$$

where $R_{rad}$ is the radiation resistance of patch 12, and patch 14, at resonance and $Z_{16}$ is the characteristic impedance of feed line 16. $Z_{23}$ is also the impedance looking into feed line 18 at point 28.

According to the present invention, it is desirable to make the characteristic impedance of 90° phase shifter 24 equal to $Z_{23}$. Phase shifter 24 is, as stated previously, a quarter-wavelength section of line. It will be understood that the impedance looking into point 23 toward patch 12 will be the same as the impedance looking into point 28 toward patch 12. At T-junction 25, then, the two branches that include feed line 18 on the one hand, and, and phase shifter 24 in series with feed line 16 on the other hand, provide an identical impedance thereby providing equal power division to each side of patch 12. Moreover, there is necessarily a phase shift difference of 90° over the two branches as required for feeding antenna element 12 due to the use of quarter-wavelength segments in constructing this aspect of the feed structure. As another advantage, the math required to solve for the characteristic impedances of the quarter- wavelength segments is simplified compared to other designs such as to the design offered in U.S. Pat. No. 5,661,494.

At T-junction 25, the impedance presented by the converging patch feeds is approximately:

$$Z_{25} = \frac{Z_{23}}{2},$$

where $Z_{25}$ is the impedance looking into the two branches at T-junction 25 toward patch 12, and $Z_{23}$ is the impedance looking into either point 23 toward patch 12 or point 28 toward patch 12.

The impedance $Z_{25}$ is usually too low for low loss transmission. Therefore, the impedance is preferably increased in the present invention via two additional quarter-wavelength transforms 26 and 30 with respective characteristic impedances $Z_{26}$ and $Z_{30}$.

The resulting impedance looking into transform 30 at point 32 toward patch 12, which will be referred to as $Z_{32}$, is given by:

$$Z_{32} = \frac{Z_{23}Z_{30}^2}{2Z_{26}^2}.$$

By selecting the characteristic impedance $Z_{30}$ of transform 30 and characteristic impedance $Z_{26}$ of transform 26, the impedance $Z_{32}$ can be set at a desired value.

The function of section 34 is to provide a path toward the next junction 38. Section 36 is a one-quarter wavelength section that has a characteristic impedance equal to that of section 34. Section 36 serves to provide a 90° phase shift relative to the phase of the electrical signal feeding the corresponding sides of patch 14. Since sections 34 and 36 possess the same characteristic impedance, there is no impedance discontinuity at junction 40 of sections 34 and 36. Moreover, quarter-wavelength transformer 26 and quarter-wavelength transformer 30 combine to result in the characteristic impedance $Z_{32}$ discussed above that is a suitable value for low loss transmission by sections 34 and 36 that are selected to have the characteristic impedance $Z_{32}$. The combination of sections 34 and 36 might be considered as one section having a different electrical length from that of section 48, in degrees based on the degree of angle of rotation of the circuitry related to patch 14 as compared to the circuitry of patch 12. Sections 34 and 36 are discussed herein as two sections for convenience of understanding but may also be referred to in this specification or otherwise as a single microstrip section that varies in electrical length.

It will be understood that the feed structure for supplying patch 14 thus far described is analogous to that of the feed structure for supplying patch 12. Sections 20 and 22 are substantially identical to 16 and 18. Section 42 is identical to section 24. Section 44 is identical to section 26. Section 46 is identical to section 30. Section 48 is identical to section 34. A section analogous to section 36 is not included in the feed structure leading to patch 14 which, as discussed before, results in a 90° phase shift for a 90° degree rotational angle between the feed structure for patch 12 and the feed structure for patch 14.

Another advantage of the present invention is provided by transformers 50 and 52 on either side of junction 38. Transformers 50 and 52 are each quarter-wavelength transformers with identical characteristic impedances. The purpose of transformers 50 and 52 is to increase the impedance seen looking into junction 38, $Z_{38}$ through both branches leading to patch 12 and patch 14. The desired increase in $Z_{38}$ would be by a factor of about two relative to $Z_{32}$ for use with a four-element transmitter. Without transformers 50 and 52, the impedance $Z_{38}$ would be equal to $Z_{32}/2$ since each of the two branches to patch 12 and patch 14 have an impedance of $Z_{32}$. This impedance would again be too low for low-loss transmission necessitating an additional quarter-wavelength transformer after T-junction 38 such as transformer 54.

It should be noted that for the two element building block circuit 10, quarter-wavelength transformer 54 is an artifact to allow testing of the two element building block circuit 10. Transformer 54 serves to transform the approximately 100 Ohm impedance of $Z_{38}$, in the present embodiment, to 50 Ohms as required by the testing equipment.

It will be noted that all bends are smoothly rounded and that sharp edges are avoided throughout most of the layout to avoid radiation losses. The junctions do possess sharp edges. Moreover, close proximity of lines is avoided as much as possible to minimize crosstalk.

Figure 2:
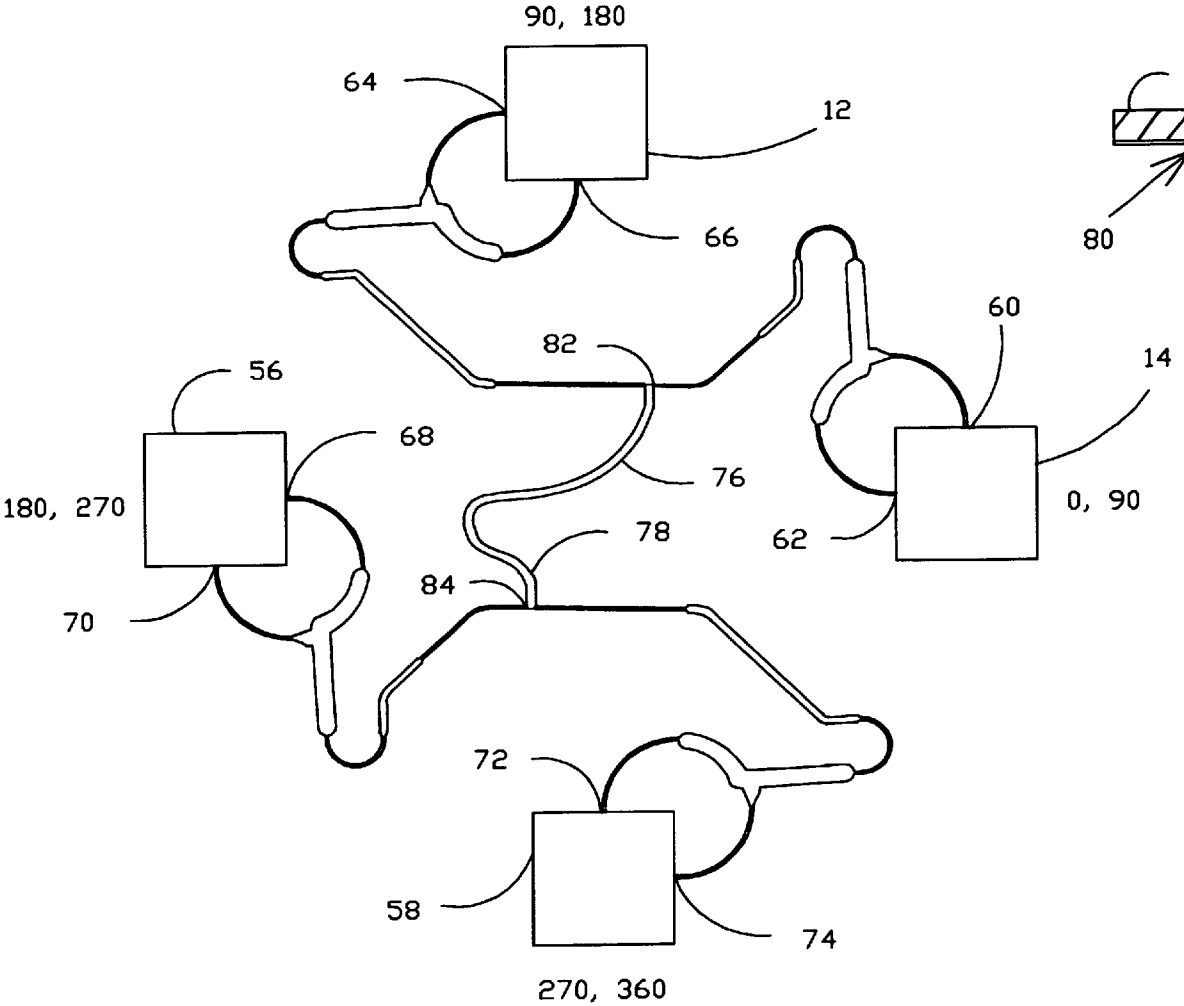
FIG. 2 is a schematic of a four element microstrip patch antenna that builds on the feed structure of FIG. 1.

FIG. 2 discloses two block units 10 placed together as a cluster array to produce circularly polarized radiation. If the collection of microstrip sections related to and including microstrip patch 14 were referred to as a Tier 1-Circuit A, then the rotated collection of microstrip sections relating to and including microstrip patch 12 could be referred to as Tier 1-Circuit B. In this example, Tier 1-Circuit B is rotated 90° counterclockwise with respect to Tier 1-Circuit A. Furthermore, if the various microstrip sections related to both microstrip patches 12 and 14 could be referred to Tier 2-Circuit A, then the various microstrip patches 56 and 58 could be referred to as Tier 2-Circuit B. It will be understood that Tier 3 and Tier 4 circuits could also be formed in the same manner as desired. In FIG. 2, the signals are fed by the feed structure such that patch 14 receives the signal at two feed points 60 and 62 with a 90° separation. Patch 12 then receives the two feed signals at a 90° difference at feed points 64 and 66. Likewise, patches 56 and 58 receive appropriately phased signals at feed points 68, 70, 72, and 74, respectively. Microstrip sections 76 and 78 are used to connect the two Tier 2 circuits together. As discussed previously, the electrical length of sections 76 and 78, which might be referred to as Tier 2-Circuit A and Tier 2-Circuit B microstrip sections, have a difference in length, measured by degrees, equal to the physical angle by which Tier 2-Circuit A is rotated to create Tier 2-Circuit B. Preferably, the characteristic impedance of microstrip sections 76 and 78 is equal to the impedance established by Tier 1-Circuit A and Tier 2-Circuit B at respective second joints 82 and 84. This avoids the need for an additional transformer as indicated in U.S. Pat. No. 5,661,494.

Figure 4:
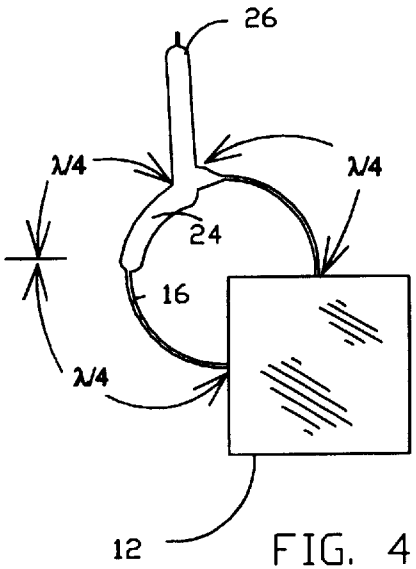
FIG. 4 is a schematic showing quarter-wavelength feed segments in accord with the present invention.
Figure 5:
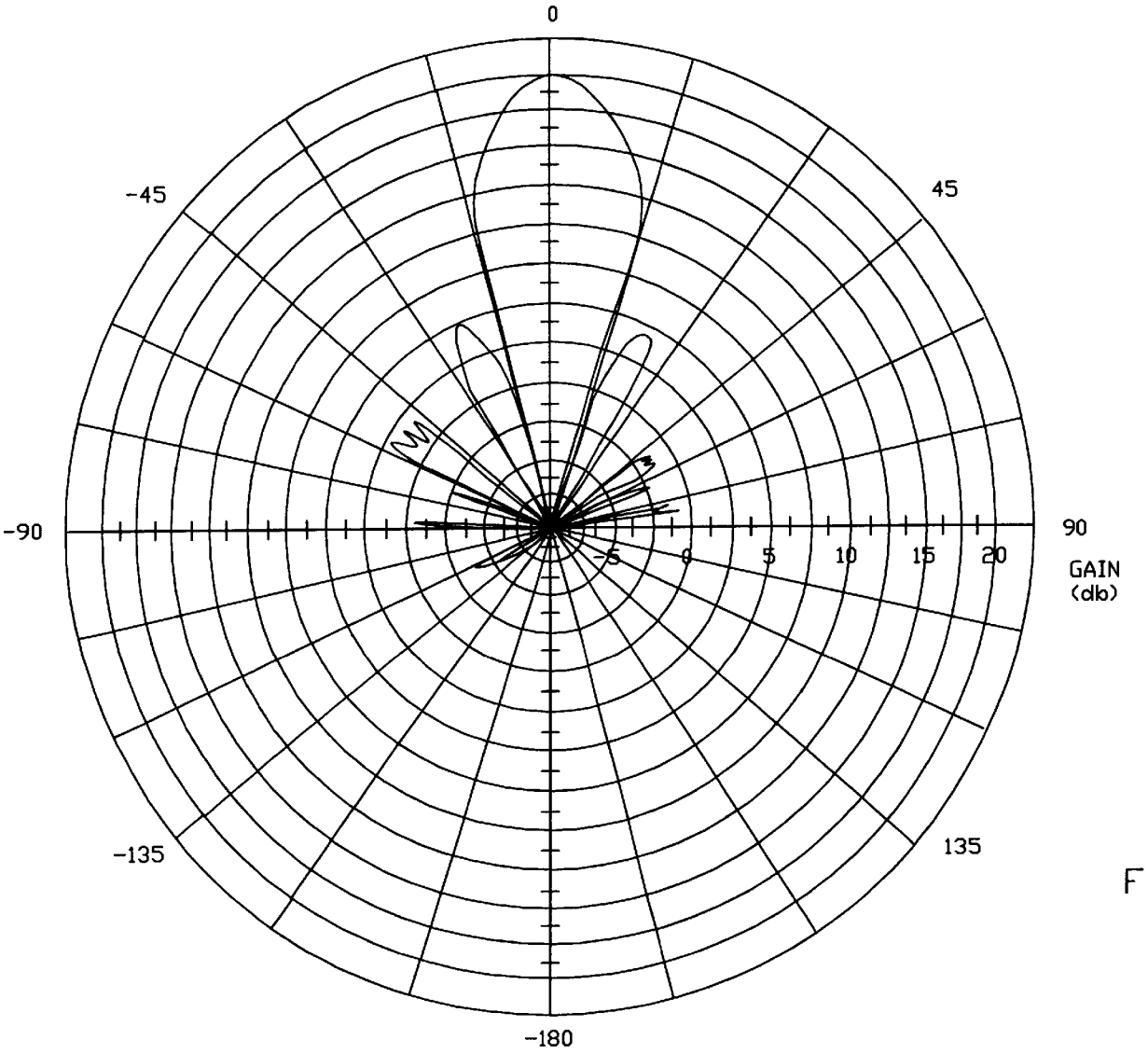
FIG. 5 is a graph of a representative response of a sixteen-element antenna using the basic feed structures shown in FIG. 1 and FIG. 2 in accord with the present invention.

FIG. 3 shows a cross-section of radiating element 12 on one side of the dielectric substrate 17 of the antenna with a thickness H and a conducting ground plane 80 on the other side. FIG. 4 illustrates that each element shown in the feed structure has an electrical length of one-quarter wavelength. FIG. 5 discloses a typical response using a 16-element array in accord with the present invention.

While the preferred embodiment circularly polarized antenna devices and methods are disclosed in accord with the law requiring disclosure of the presently preferred embodiment of the invention, other embodiments of the disclosed concepts may also be used. Therefore, the foregoing disclosure and description of the invention are illustrative and explanatory thereof, and various changes in the method steps and also the details of the apparatus may be made within the scope of the appended claims without departing from the spirit of the invention.

What is claimed is:

1. A method for a microstrip feeder structure for a microstrip antenna array, said microstrip antenna array having a plurality of radiating elements and an antenna operating frequency, each of said radiating elements having a radiation resistance at resonance, said method comprising:

providing first and second microstrip feed lines for connecting to each of said radiating elements, said first and second feed lines each having an electrical length of approximately one-quarter wavelength at said antenna operating frequency, said first and second feed lines having identical characteristic impedances equal to a first characteristic impedance;

providing a third microstrip section in series with said first microstrip feed line;

selecting a length of said third microstrip section to provide a ninety-degree phase shift;

selecting said third microstrip section to provide a third characteristic impedance equal to the impedance looking into said first feed line toward a respective one of said plurality of radiating elements; and connecting an end of said third microstrip section and an end of said second microstip section together to form a first joint.

2. The method of claim 1, further comprising:

providing a fourth microstrip section connected to said first joint;

providing a fifth microstrip section connected in series to said fourth microstrip section;

adjusting an impedance looking into said fifth microstrip section toward said respective one of said radiating elements to provide an adjusted impedance by selecting a fourth characteristic impedance for said fourth microstrip section and a fifth characteristic impedance for said fifth microstrip section.

3. The method of claim 2, further comprising:

providing that said first, second, third, fourth, and fifth microstrip sections form a Tier 1-Circuit A; and copying and rotating said Tier 1-Circuit A to provide a Tier 1-Circuit B.

4. The method of claim 3, further comprising:

selecting said rotating to be clockwise or counterclockwise for providing either left-handed or right-handed polarization, respectively, for said microstrip antenna array.

5. The method of claim 4, further comprising:

providing a Circuit A sixth microstrip section connected in series to said fifth section of said Tier 1-Circuit A, providing a Circuit B sixth microstrip section connected in series to said fifth section of said Tier 1-Circuit B, providing said Circuit A and said Circuit B sixth microstrip sections with a characteristic impedance equal to an impedance looking into said fifth microstrip section, and providing that said Circuit A sixth microstrip section and said circuit B sixth microstrip section differ in an electrical length related to an amount corresponding to angle of rotation of said Tier 1-Circuit A with respect to said Tier 1-Circuit B.

6. The method of claim 5, further comprising:

providing a Circuit A seventh microstrip section in series with said Circuit A sixth microstrip section, providing a Circuit B seventh microstrip section in series with said Circuit B seventh microstrip section, and joining respective ends of said Circuit A seventh microstrip section and said Circuit B seventh microstrip sections to form a second joint.

7. The method of claim 6, further comprising:

providing a two-element microstrip antenna array by connecting an eighth microstrip section to said second joint.

8. The method of claim 6, further comprising:

providing that said Tier 1-Circuit A and said Tier 1-Circuit B collectively form a Tier 2-Circuit A, providing a four-element microstrip antenna array by copying and rotating said Tier 2-Circuit A to provide a Tier 2-Circuit B, and connecting a Circuit A eighth microstrip section and a Circuit B eighth microstrip section, respectively, to said second joint of each of said Tier 2-Circuit A and said Tier 2-Circuit B.

9. A microstrip feeder structure for a microstrip antenna array, said microstrip antenna array having a plurality of radiating elements and an antenna operating frequency, each of said radiating elements having a radiation resistance at resonance, said microstrip feeder structure comprising:

first and second microstrip feed lines for connecting with each of said radiating elements, said first and second microstrip lines each having a substantially identical first characteristic impedance and a substantially identical first electrical length equal to one-quarter wavelength at said antenna operating frequency; and a third microstrip section in series with said second microstrip feed line having an electrical length of one-quarter of a wavelength, said third microstrip section having a third characteristic impedance related to a square of said first characteristic impedance divided by said radiation resistance, said third microstrip section providing a ninety-degree phase shift of a feed signal, said third microstrip section being electrically connected to said first microstrip feed line at a first joint.

10. The microstrip feeder structure of claim 9, further comprising:

a fourth microstrip section being electrically connected to said first joint, said fourth microstrip section having a fourth characteristic impedance, a fifth microstrip section having first and second opposing ends with said first end making a series connection with said fourth microstrip section, said fifth microstrip section having a fifth characteristic impedance, an adjusted line impedance looking into said second end of said fifth microstrip section toward said first end being related to said third characteristic impedance times a ratio of said fourth and fifth characteristic impedances.

11. The microstrip feeder structure of claim 10, further comprising:

said adjusted line impedance looking into said second end of said fifth microstrip section toward said first end being equal to said third characteristic impedance divided by two with the result being multiplied times a squared ratio of said fifth characteristic impedance divided by said fourth characteristic impedance.

12. The microstrip feeder structure of claim 11, further comprising:

said first, second, third, fourth, and fifth microstrip sections forming a Tier 1 circuit for feeding each of said radiating elements.

13. The microstrip feeder structure of claim 12, further comprising:

two of said Tier 1 circuits which are rotated with respect to each other to form a Tier 1 -Circuit A and a Tier 1 -Circuit B, respectively.

14. The microstrip feeder structure of claim 13, further comprising:

a Circuit A sixth microstrip section connected to said Tier 1 -Circuit A, and a Circuit B sixth microstrip section connected to said Tier 1 -Circuit B.

15. The microstrip feeder structure of claim 13, further comprising:

said Circuit A sixth microstrip section and said Circuit B sixth microstrip section having a difference in respective electrical lengths related to an angle of rotation between said Tier 1 -Circuit A and said Tier 1 -Circuit B.

16. The microstrip feeder structure of claim 15, further comprising said Circuit A sixth microstrip section and said Circuit B sixth microstrip section each having a characteristic impedance equal to an impedance seen looking into a respective said fifth microstrip section.

17. The microstrip feeder structure of claim 16, further comprising a Circuit A seventh microstrip section in series with said Circuit A sixth microstrip section, and a Circuit B seventh microstrip section in series with said Circuit B sixth microstrip section, said Circuit A seventh microstrip section and said Circuit B seventh microstrip section being connected to form a second joint.

18. The microstrip feeder structure of claim 17, further comprising said Tier 1 -Circuit A including said Circuit A sixth microstrip section and said Circuit A seventh microstrip section combining with said Tier 1 -Circuit B including said Circuit B sixth microstrip section and said Circuit B seventh microstrip section to form a Tier 2 -Circuit A, and a copy of said Tier 2 -Circuit A rotated with respect to said Tier 2 -Circuit A to form a Tier 2 -Circuit B.

19. A microstrip feeder structure for a microstrip antenna array, said microstrip antenna array including a plurality of radiating elements, each of said radiating elements having a radiation resistance at resonance, said microstrip feeder structure comprising:

a plurality of first microstrip sections having an electrical length of one-quarter wavelength, each of said plurality of first microstrip sections terminating at one end with a respective one of said plurality of radiating elements;

a plurality of second microstrip sections having an electrical length of one-quarter wavelength, each of said plurality of second microstrip sections terminating at one end with said respective one of said plurality of radiating elements;

a plurality of third microstrip sections having an electrical length of one-quarter wavelength, each of said plurality of third microstrip sections connecting at one end to respective of said plurality of second microstrip sections, each of said plurality of third microstrip sections connecting at an opposite end to respective of said plurality of first microstrip sections to form a plurality of first joints;

a plurality of fourth microstrip sections, each of said plurality of fourth microstrip sections connecting at one end to a respective one of said plurality of first joints;

a plurality of fifth microstrip sections, each of said plurality of fifth microstrip sections connecting at one end to a respective of said plurality of fourth microstrip sections, each of said plurality of first, second, third, fourth, and fifth microstrip sections forming a plurality of Tier 1 circuits, each said plurality of Tier 1 circuits being rotated with respect to each other, one-half of said Tier 1 circuits being designated as a Tier 1 -Circuit A and one-half of said Tier 1 circuits being designated a Tier 1 -Circuit B.

20. The microstrip feeder structure of claim 19, further comprising:

a Circuit A sixth microstrip section connected to each said Tier 1 -Circuit A, and a Circuit B sixth microstrip section connected to each said Tier 1 -Circuit B, said Circuit A sixth microstrip section and said Circuit B sixth microstrip section having an electrical length differing with respect to each other by an angle of rotation between each said Tier 1 -Circuit A and said Tier 1 -Circuit B.

21. The microstrip feeder structure of claim 20, further comprising:

a Circuit A seventh microstrip section connecting to each Circuit A sixth microstrip section, and a Circuit B seventh microstrip section connecting to each Circuit B sixth microstrip section, said Circuit A seventh microstrip section connecting to said Circuit B seventh microstrip section.

22. The microstrip feeder structure of claim 21, further comprising:

each said Tier 1-Circuit A and said Circuit A sixth microstrip section and said Circuit A seventh microstrip section and said Tier 1-Circuit B and said Circuit B sixth microstrip section and said Circuit B seventh microstrip section forming a Tier 2-Circuit A, and a Tier 2-Circuit B identical to said Tier 2-Circuit A being rotated with respect to said Tier 2-Circuit A.

23. The microstrip feeder structure of claim 22, further comprising:

a circuit A eighth microstrip section connecting to said Tier 2-Circuit A, and a circuit B eighth microstrip section connecting to said Tier 2-Circuit B.

24. The microstrip feeder structure of claim 23, further comprising:

said circuit A eighth microstrip section varying in electrical length with respect to said circuit B eighth microstrip section by an amount related to an angle of rotation of said Tier 2-Circuit A with respect to said Tier 2-Circuit B.

25. The microstrip feeder structure of claim 19, further comprising:

said first and second microstrip sections each having an identical smoothly curved shape and having an identical characteristic impedance.

26. The microstrip feeder structure of claim 19, further comprising:

said third microstrip sections having a smoothly curved configuration.

27. The microstrip feeder structure of claim 19, further comprising:

said fourth microstrip sections being substantially straight.

28. The microstrip feeder structure of claim 19, further comprising:

said fifth microstrip sections including a substantially U-shaped portion.

29. A microstrip feeder structure for a microstrip antenna array, said microstrip antenna array including a plurality of radiating elements, each of said radiating elements having a radiation resistance at resonance, said microstrip feeder structure comprising:

a Tier 1-Circuit A comprising a Circuit A radiating element and a Circuit A feed structure;

a Tier 1- Circuit B comprising a Circuit B radiating element and a Circuit B feed structure;

said Tier 1-Circuit A and said Tier 1-Circuit B forming a Tier 2-Circuit A;

a Tier 2-Circuit B identical to said Tier 1-Circuit A and rotated by an angle of rotation with respect to said Tier 1-Circuit A;

a Circuit A microstrip section connected to a Tier 2-Circuit A connection point of said Tier 2-Circuit A;

a Circuit B microstrip section connected to a Tier 2-Circuit B connection point of said Tier 2-Circuit B, said Circuit A microstrip section and said Circuit B microstrip section having an identical characteristic impedance, said characteristic impedance being equal to an impedance looking into either of said respective Tier 2-Circuit A connection point or said Tier 2-Circuit B connection point, said Circuit A microstrip section and said Circuit B microstrip section having an electrical length that differs with respect to each other by an electrical length related to said angle of rotation, said Circuit A microstrip section and said Circuit B microstrip section being connected to each other.

* * * * *